US011131326B2

(12) United States Patent
Kawashima

(10) Patent No.: US 11,131,326 B2
(45) Date of Patent: Sep. 28, 2021

(54) EJECTOR, EJECTOR PRODUCTION METHOD, AND METHOD FOR SETTING DIFFUSER OUTLET FLOW PATH

(71) Applicant: TLV CO., LTD., Hyogo (JP)

(72) Inventor: Fumihiro Kawashima, Kakogawa (JP)

(73) Assignee: TLV CO., LTD., Hyogo (JP)

( * ) Notice: Subject to any disclaimer, the term of this patent is extended or adjusted under 35 U.S.C. 154(b) by 155 days.

(21) Appl. No.: 16/146,915

(22) Filed: Sep. 28, 2018

(65) Prior Publication Data

US 2019/0032678 A1 Jan. 31, 2019

Related U.S. Application Data

(63) Continuation of application No. PCT/JP2017/005468, filed on Feb. 15, 2017.

(30) Foreign Application Priority Data

Apr. 1, 2016 (JP) ..... JP2016-074552

(51) Int. Cl.
*F04F 5/46* (2006.01)
*F04F 5/18* (2006.01)
(Continued)

(52) U.S. Cl.
CPC ..... *F04F 5/461* (2013.01); *F04F 5/16* (2013.01); *F04F 5/18* (2013.01); *F04F 5/20* (2013.01);
(Continued)

(58) Field of Classification Search
CPC ..... F04F 5/46; F04F 5/461; F04F 5/20; F04F 5/16; F04F 5/463; F04F 5/18; F04F 5/10;
(Continued)

(56) References Cited

U.S. PATENT DOCUMENTS 2,888,191 A * 5/1959 Neumann ..... F04F 5/461 417/182
3,448,691 A 6/1969 Frazier
(Continued)

FOREIGN PATENT DOCUMENTS

CN 104801435 A 7/2015
FR 2239142 A5 2/1975
(Continued)

OTHER PUBLICATIONS

An Office Action issued by the Chinese Patent Office dated May 28, 2019, which corresponds to Chinese Patent Application No. 201780019768.5 and is related to U.S. Appl. No. 16/146,915; with English language translation.
(Continued)

*Primary Examiner* — Peter J Bertheaud
(74) *Attorney, Agent, or Firm* — Studebaker & Brackett PC

(57) ABSTRACT

An ejector includes a nozzle, a suction chamber, and a diffuser. A diffuser further includes an attachment configured to change the dimensions of the outlet flow path. The attachment changes the length X of a narrowed flow path and the length Y and the inner diameter D of a parallel flow path such that expressions (1) and (2) are satisfied:

$$X=A\times D \quad (1),$$

and $$Y=B\times D \quad (2).$$

2 Claims, 2 Drawing Sheets

(51) Int. Cl.

| | |
|---|---|
| ***F04F 5/20*** | (2006.01) |
| ***F04F 5/24*** | (2006.01) |
| ***F04F 5/48*** | (2006.01) |
| ***F04F 5/44*** | (2006.01) |
| ***F04F 5/16*** | (2006.01) |
| ***F04F 5/10*** | (2006.01) |
| *F04F 5/14* | (2006.01) |
| *F04F 5/04* | (2006.01) |

(52) U.S. Cl.
CPC ..... *F04F 5/24* (2013.01); *F04F 5/44* (2013.01); *F04F 5/46* (2013.01); *F04F 5/48* (2013.01); *F04F 5/04* (2013.01); *F04F 5/10* (2013.01); *F04F 5/14* (2013.01); *F04F 5/463* (2013.01)

(58) Field of Classification Search
CPC ..... F04F 5/24; F04F 5/48; F04F 5/04; F04F 5/14; F04F 5/44
See application file for complete search history.

(56) References Cited

U.S. PATENT DOCUMENTS

| | | | | |
|---|---|---|---|---|
| 3,891,353 | A * | 6/1975 | Templeman | F04F 5/18 417/183 |
| 4,586,873 | A * | 5/1986 | Lepretre | F04F 5/48 417/54 |
| 4,595,344 | A * | 6/1986 | Briley | F04F 5/48 239/546 |
| 4,898,517 | A | 2/1990 | Eriksen | |
| 6,877,960 | B1 | 4/2005 | Presz, Jr. et al. | |
| 9,140,470 | B2 * | 9/2015 | Verma | F25B 1/06 |
| 2009/0297367 | A1 * | 12/2009 | Yamada | F04F 5/46 417/151 |
| 2015/0292524 | A1 * | 10/2015 | Beg | F04F 5/463 417/151 |
| 2016/0187037 | A1 * | 6/2016 | Jeong | F25B 41/00 62/511 |

FOREIGN PATENT DOCUMENTS

| | | | |
|---|---|---|---|
| JP | S57-79152 | U1 | 5/1982 |
| JP | 2000-356305 | A | 12/2000 |
| KR | 2002-0028521 | A | 4/2002 |

OTHER PUBLICATIONS

Extended European Search Report issued by the European Patent Office dated Feb. 22, 2019, which corresponds to EP17773766.5-1004 and is related to U.S. Appl. No. 16/146,915.

* cited by examiner

EJECTOR, EJECTOR PRODUCTION METHOD, AND METHOD FOR SETTING DIFFUSER OUTLET FLOW PATH

CROSS-REFERENCE TO RELATED APPLICATION

This is a continuation of PCT International Application PCT/JP2017/005468 filed on Feb. 15, 2017, which claims priority to Japanese Patent Application No. 2016-074552 field on Apr. 1, 2016. The disclosures of these applications including the specifications, the drawings, and the claims are hereby incorporated by reference in their entirety.

FIELD

The technique disclosed herein relates to an ejector configured to suck second fluid by negative pressure generated by ejection of first fluid to discharge the second fluid together with the first fluid, the method for manufacturing the ejector, and the method for setting an outlet flow path of a diffuser used for the ejector.

BACKGROUND

For example, a general ejector is disclosed in Japanese Patent Publication No. 2000-356305. In this ejector, negative pressure (pressure drop) is generated by ejection of first fluid (drive fluid) from an injection port, and second fluid (drive target fluid) is sucked by the negative pressure. Then, the first fluid and the second fluid are mixed and discharged from a diffuser (an outlet). An expanded flow path (a flow path whose flow path sectional area increases toward a downstream side) is provided at the diffuser. When the fluid mixture of the first fluid and the second fluid flows in the expanded flow path, the velocity of the fluid mixture decreases, and the pressure of the fluid mixture increases. The fluid mixture discharged from the ejector as described above is supplied to, e.g., an apparatus on the downstream side of the ejector.

SUMMARY

In the above-described ejector, a discharge pressure might change due to, e.g., a change in operation conditions (the usage amount or usage pressure of the fluid mixture) of the apparatus as a steam supply destination. For example, when the operation of temporarily decreasing the usage amount of the fluid mixture in the apparatus as the supply destination or temporarily increasing the usage pressure is performed, the discharge flow rate of the ejector decreases, and the discharge pressure increases. When the discharge pressure becomes too high, the second fluid is less sucked, and eventually, the suction flow rate of the second fluid significantly decreases. In this case, an ejector configured so that a sufficient suction flow rate of second fluid can be ensured until the highest possible discharge pressure has been demanded.

Performance of the ejector such as the discharge pressure of the fluid mixture and the suction flow rate of the second fluid varies according to the specifications, i.e., the dimensions, of the flow path of the diffuser. Note that various dimensions of the flow path of the diffuser influence the performance of the ejector, and for this reason, a change in the dimensions of the diffuser might lower the performance of the ejector.

The technique disclosed herein has been made in view of the above-described situation, and an object of the technique is to change an upper discharge pressure limit for ensuring a second fluid suction flow rate while reducing degradation of performance of an ejector upon such a change.

The ejector disclosed herein includes a nozzle configured to eject first fluid, a suction chamber configured to house the nozzle and to suck second fluid by negative pressure generated by ejection of the first fluid from the nozzle, and a diffuser including an outlet flow path and configured to mix and discharge the first fluid and the second fluid of the suction chamber. The outlet flow path includes a narrowed flow path having a sectional area narrowed toward downstream, a parallel flow path connected to a downstream end of the narrowed flow path and having a constant sectional area, and an expanded flow path connected to a downstream end of the parallel flow path and having a sectional area expanded toward downstream. The diffuser further includes a changing unit configured to change the dimensions of the outlet flow path. The changing unit changes the length X of the narrowed flow path and the length Y and the inner diameter D of the parallel flow path such that expressions (1) and (2) represented using constants A, B are satisfied:

$$X=A\times D \quad (1),$$

and $$Y=B\times D \quad (2).$$

Moreover, the method for manufacturing the ejector as disclosed herein includes the setting step of setting the dimensions of the outlet flow path, and the preparation step of preparing the diffuser having the dimensions of the outlet flow path set at the setting step. At the setting step, the length X of the narrowed flow path and the length Y and the inner diameter D of the parallel flow path are set to satisfy the above-described expressions (1) and (2).

Further, the method for setting the outlet flow path of the diffuser as disclosed herein includes the step of setting the length X of the narrowed flow path such that the above-described expression (1) represented using the inner diameter D of the parallel flow path and the constant A is satisfied, and the step of setting the length Y of the parallel flow path such that the above-described expression (2) represented using the inner diameter D and the constant B is satisfied.

According to the above-described ejector, while the upper discharge pressure limit for ensuring the suction flow rate of the second fluid can be changed, degradation of the performance of the ejector can be reduced upon such a change.

According to the above-described method for manufacturing the ejector, the ejector can be provided, which is configured to reduce degradation of the performance of the ejector upon a simultaneous change of the upper discharge pressure limit for ensuring the suction flow rate of the second fluid.

According to the above-described method for setting the outlet flow path of the diffuser, the ejector can be realized, which is configured to reduce degradation of the performance of the ejector upon a simultaneous change of the upper discharge pressure limit for ensuring the suction flow rate of the second fluid.

DESCRIPTION OF EMBODIMENTS

Figure 1:
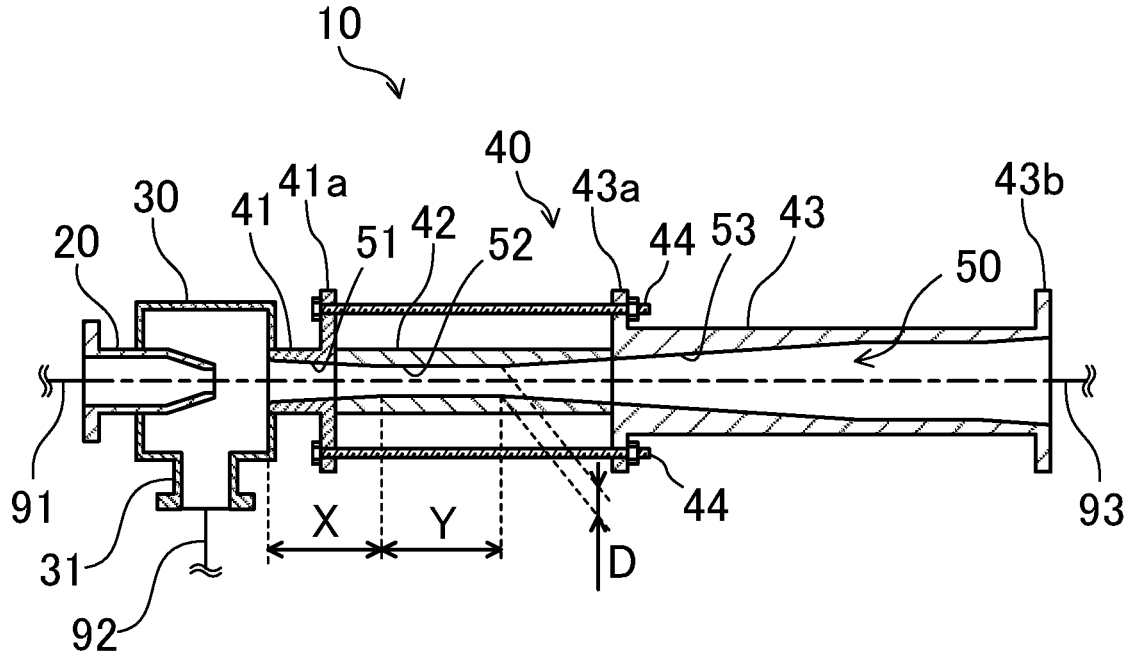
FIG. 1 is a schematic view of a configuration of an ejector according to an embodiment.

Hereinafter, an exemplary embodiment will be described in detail with reference to the drawings.

An ejector 10 is a steam ejector configured to suck low-pressure steam (second fluid) by ejection of high-pressure steam (first fluid), thereby mixing and discharging these types of steam. That is, in the ejector 10, the high-pressure steam is drive fluid, and the low-pressure steam is suction fluid. The ejector 10 includes a nozzle 20, a suction chamber 30, and a diffuser 40.

An inflow pipe 91 connected to a high-pressure steam supply source is connected to the nozzle 20. The nozzle 20 is configured to eject the supplied high-pressure steam. A tip end portion of the nozzle 20 is housed in the suction chamber 30.

A low-pressure steam suction port 31 is provided at the suction chamber 30. Using negative pressure (pressure drop) generated by ejection of the high-pressure steam from the nozzle 20, the low-pressure steam is sucked into the suction chamber 30 through the suction port 31. That is, in the suction chamber 30, suction force for sucking the low-pressure steam is generated by the negative pressure generated by a jet pump effect of the high-pressure steam. A suction pipe 92 connected to a low-pressure steam supply source is connected to the suction port 31.

The diffuser 40 is connected to the suction chamber 30. The diffuser 40 is configured to mix and discharge the high-pressure steam ejected to the suction chamber 30 and the low-pressure steam sucked into the suction chamber 30. An outflow pipe 93 connected to a steam mixture supply destination is connected to a downstream end of the diffuser 40.

The diffuser 40 has a divided structure including an upstream portion 41, an attachment 42, and a downstream portion 43. An upstream end of the upstream portion 41 is connected to the suction chamber 30. A flange 41*a* is provided at a downstream end of the upstream portion 41. A first flange 43*a* is provided at an upstream end of the downstream portion 43, and a second flange 43*b* is provided at a downstream end of the downstream portion 43. The downstream portion 43 is connected to the outflow pipe 93 through the second flange 43*b*. The attachment 42 is sandwiched between the upstream portion 41 and the downstream portion 43. The flange 41*a* of the upstream portion 41 and the first flange 43*a* of the downstream portion 43 are fastened with bolts 44, and in this manner, the attachment 42 is held by the upstream portion 41 and the downstream portion 43. That is, the attachment 42 can be replaced by loosening of the fastened bolts 44. The attachment 42 is one example of a changing unit.

An outlet flow path 50 of the high-pressure steam and the low-pressure steam is formed at the diffuser 40, the outlet flow path 50 communicating with the suction chamber 30. The outlet flow path 50 includes a narrowed flow path 51, a parallel flow path 52, and an expanded flow path 53 in this order from an upstream side. The section of the outlet flow path 50 is in a substantially circular shape. The diffuser 40 decreases the velocity of the steam mixture and increases the pressure of the steam mixture when the steam mixture flows in the expanded flow path 53.

An upstream end of the narrowed flow path 51 opens to the suction chamber 30. The upstream end of the narrowed flow path 51 faces a downstream end of the nozzle 20 in the suction chamber 30. The sectional area, i.e., the inner diameter, of the narrowed flow path 51 gradually decreases toward a downstream side. The parallel flow path 52 is connected to a downstream end of the narrowed flow path 51. The parallel flow path 52 is a flow path having a constant sectional area, i.e., a constant inner diameter. The parallel flow path 52 is a portion having the smallest inner diameter in the outlet flow path 50, and forms a so-called throat portion. The expanded flow path 53 is connected to a downstream end of the parallel flow path 52. The sectional area, i.e., the inner diameter, of the expanded flow path 53 gradually increases toward the downstream side.

The narrowed flow path 51 is formed from the upstream portion 41 to the attachment 42. The parallel flow path 52 is formed at the attachment 42. The expanded flow path 53 is formed from the attachment 42 to the downstream portion 43. That is, at least an upstream end portion of the narrowed flow path 51 is formed at the upstream portion 41. At least a downstream end portion of the narrowed flow path 51, the parallel flow path 52, and at least an upstream end portion of the expanded flow path 53 are formed at the attachment 42. At least a downstream end portion of the expanded flow path 53 is formed at the downstream portion 43.

In the ejector 10 configured as described above, the high-pressure steam flowing in the inflow pipe 91 is ejected to the suction chamber 30 through the nozzle 20, and the low-pressure steam is sucked into the suction chamber 30 through the suction port 31 by ejection of the high-pressure steam. Then, the high-pressure steam and the low-pressure steam in the suction chamber 30 are mixed together, and are discharged from the diffuser 40. The steam discharged from the diffuser 40 is supplied to an apparatus on the downstream side. The flow velocity of the steam mixture reaches about a sound velocity at the parallel flow path 52 of the diffuser 40. Thereafter, when the steam mixture flows in the expanded flow path 53, the velocity of the steam mixture is decreased, and the pressure of the steam mixture is increased.

Figure 2:
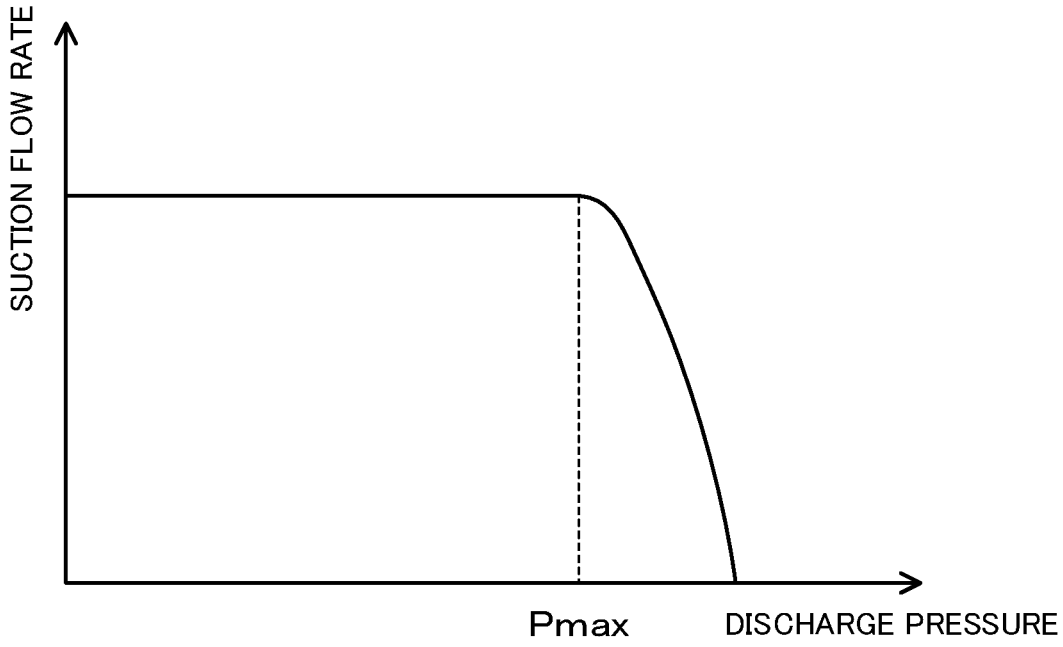
FIG. 2 is a graph of a relationship between a discharge pressure and a suction flow rate.

The discharge pressure of the ejector 10 might increase according to an operation status or a specification change of the apparatus as the steam supply destination. However, as illustrated in FIG. 2, there is an upper discharge pressure limit (this discharge pressure will be hereinafter referred to as a "maximum discharge pressure") for ensuring a low-pressure steam suction flow rate in the ejector 10. When the discharge pressure increases beyond the maximum discharge pressure Pmax, a suction pressure also starts increasing. Eventually, the flow velocity in the parallel flow path 52 decreases as compared to the sound velocity, and a non-critical state is brought. Accordingly, the suction pressure increases to a value substantially equal to the discharge pressure. That is, when the discharge pressure exceeds the maximum discharge pressure Pmax, the low-pressure steam suction flow rate decreases rapidly.

The maximum discharge pressure Pmax can be changed according to the specifications, i.e., the dimensions, of the outlet flow path 50. For example, it is conceivable that the inner diameter D of the parallel flow path 52 is decreased in order to increase the maximum discharge pressure Pmax. With a decrease in the inner diameter D of the parallel flow path 52, the flow velocity of the steam mixture in the parallel flow path 52 increases, and therefore, a critical state of the pressure in the parallel flow path 52 is easily ensured.

However, when only the inner diameter D of the parallel flow path 52 is changed, not only the maximum discharge pressure Pmax cannot be increased, but also performance of the ejector 10 cannot be maintained. For example, the low-pressure steam suction flow rate might significantly decrease while the maximum discharge pressure Pmax is increased. Conversely, the maximum discharge pressure Pmax might decrease. That is, the performance of the ejector 10 relates to various dimensions of the outlet flow path 50, and other dimensions of the parallel flow path 52 than the inner diameter D need to be changed.

For these reasons, in the ejector 10, the dimensions of the narrowed flow path 51 and the parallel flow path 52 are set such that the following expressions (1) and (2) are satisfied. That is, even in a case where the dimensions of the narrowed flow path 51 and the parallel flow path 52 are changed, the expressions (1) and (2) are satisfied before and after change.

$$X=A\times D \quad (1),$$

and $$Y=B\times D \quad (2),$$

where X represents the length of the narrowed flow path 51, Y represents the length of the parallel flow path 52, A is a constant, B is a constant, and D represents the inner diameter of the parallel flow path 52.

That is, the length X of the narrowed flow path 51 and the length Y of the parallel flow path 52 change in proportion to the inner diameter D of the parallel flow path 52. Moreover, even when the dimensions of the narrowed flow path 51 and the parallel flow path 52 are changed, the ratio (X/D) of the length X of the narrowed flow path 51 to the inner diameter D of the parallel flow path 52 is constant at A, and the ratio (Y/D) of the length Y of the parallel flow path 52 to the inner diameter D of the parallel flow path 52 is constant at B. As a result, the ratio (Y/X) of the length Y of the parallel flow path 52 to the length X of the narrowed flow path 51 is constant at B/A.

In other words, X/D is substantially equal between before and after change, and Y/D is substantially equal between before and after change.

Note that the length of the expanded flow path 53 is set to such a value that the performance of the ejector 10 is not influenced even when the lengths of the narrowed flow path 51 and the parallel flow path 52 are changed.

The diffuser 40 is configured such that the dimensions of the outlet flow path 50 can be changed by replacement of the attachment 42. With this configuration, the dimensions of the outlet flow path 50 can be easily changed without replacement of the entirety of the ejector 10.

Figure 3:
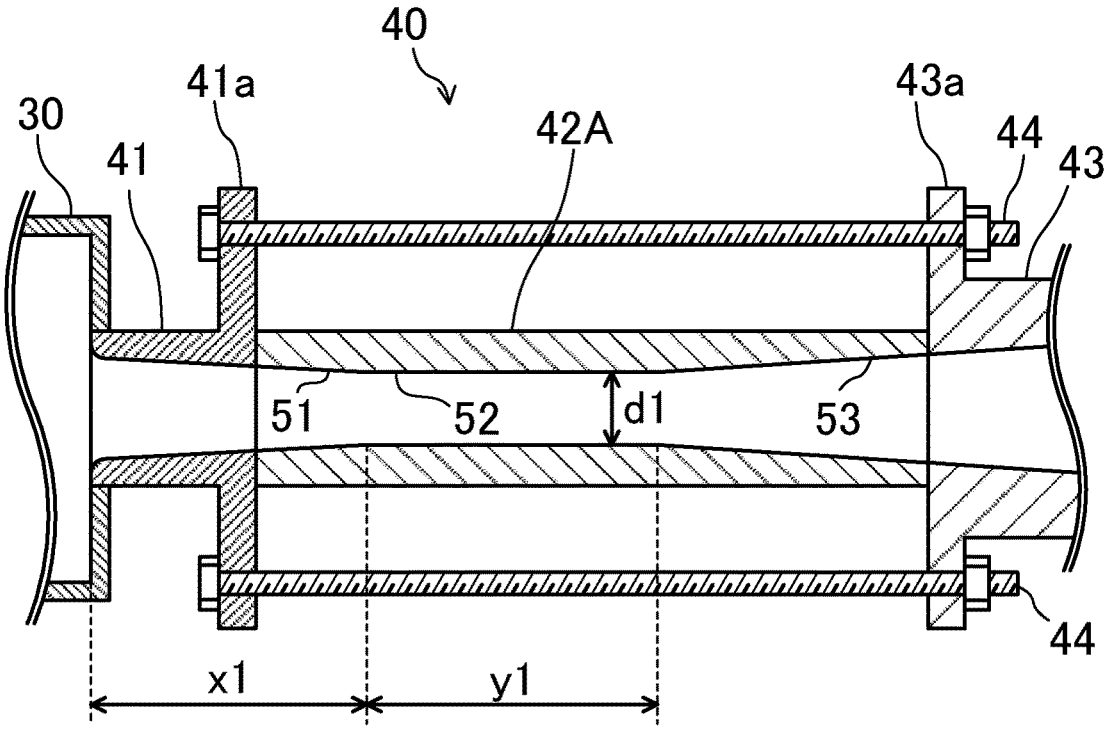
FIG. 3 is a schematic sectional view of a diffuser to which a first attachment is attached.
Figure 4:
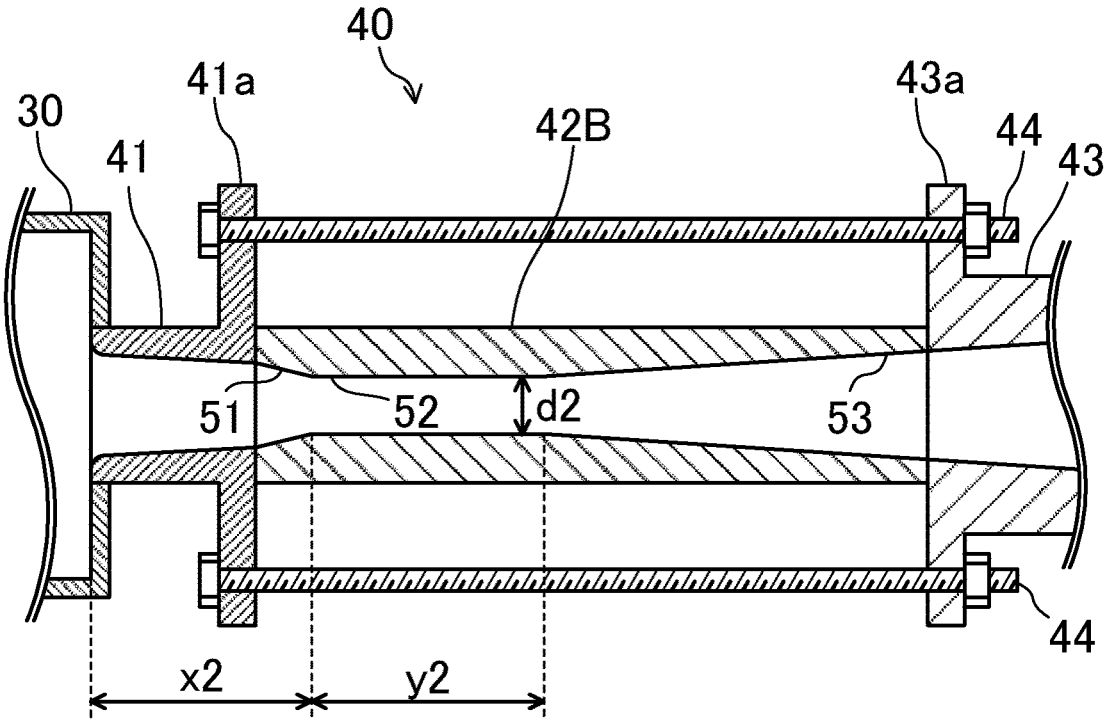
FIG. 4 is a schematic sectional view of a diffuser to which a second attachment is attached.

FIG. 3 is a schematic sectional view of the diffuser 40 to which a first attachment 42A is attached, and FIG. 4 is a schematic sectional view of the diffuser 40 to which a second attachment 42B is attached.

The first attachment 42A has the parallel flow path 52 whose inner diameter D is d1. In this case, the length x1 of the narrowed flow path 51 is A×d1, and the length y1 of the parallel flow path 52 is B×d1. On the other hand, the second attachment 42B has the parallel flow path 52 whose inner diameter D is d2. In the case of the second attachment 42B, the length x2 of the narrowed flow path 51 is A×d2, and the length y2 of the parallel flow path 52 is B×d2. The inner diameter d2 of the parallel flow path 52 of the second attachment 42B is smaller than the inner diameter d1 of the parallel flow path 52 of the first attachment 42A. Thus, the narrowed flow path 51 and the parallel flow path 52 of the second attachment 42B are shorter than those of the first attachment 42A.

Note that the entire lengths of the first attachment 42A and the second attachment 42B are the same as each other, and therefore, the length of the expanded flow path 53 in the second attachment 42B is, in the second attachment 42B, increased by an amount corresponding to the decrement of the narrowed flow path 51 and the parallel flow path 52. Moreover, only a portion of the narrowed flow path 51 formed at the second attachment 42B is changed, and therefore, the angle of an inner peripheral wall with respect to the axis of the narrowed flow path 51 is different between a portion formed at the upstream portion 41 and a portion formed at the second attachment 42B. Similarly, only a portion of the expanded flow path 53 formed at the second attachment 42B is changed, and therefore, the angle of the inner peripheral wall with respect to the axis of the expanded flow path 53 is different between a portion formed at the second attachment 42B and a portion formed at the downstream portion 43.

As described above, the inner diameter d2 of the parallel flow path 52 of the second attachment 42B is smaller than that of the first attachment 42A, and therefore, the maximum discharge pressure Pmax of the diffuser 40 into which the second attachment 42B is incorporated is higher than that in the case of incorporating the first attachment 42A. In this case, the relationship of the expressions (1) and (2) is maintained before and after change in the dimensions of the outlet flow path 50. That is, x2/d2 is substantially equal to x1/d1, and y2/d2 is substantially equal to y1/d2. Thus, the maximum discharge pressure Pmax can be increased while the performance of the ejector 10 can be maintained. Specifically, the maximum discharge pressure Pmax can be increased with a sufficient suction flow rate being ensured. Note that the inner diameter D of the parallel flow path 52 is decreased, and therefore, the low-pressure steam suction flow rate is slightly decreased. As a result, the low-pressure steam suction flow rate can be ensured even when the discharge pressure of the ejector 10 increases due to the operation status or the specification change of the apparatus as the steam supply destination.

Subsequently, the method for manufacturing the above-described ejector 10 will be described.

Specifically, the method for manufacturing the ejector 10 includes the setting step of setting the dimensions of the outlet flow path 50, and the preparation step of preparing the diffuser 40 having the dimensions set at the setting step.

At the setting step, the length X of the narrowed flow path 51 and the length Y and the inner diameter D of the parallel flow path 52 are set. At this step, the length X of the narrowed flow path 51 and the length Y and the inner diameter D of the parallel flow path 52 are set such that the expressions (1) and (2) are satisfied. For example, the inner diameter D of the parallel flow path 52 is set, and accordingly, the length X of the narrowed flow path 51 and the length Y of the parallel flow path 52 are set. Thereafter, the length of the expanded flow path 53 is set. In a case where the entire length of the diffuser 40 is fixed as in the ejector 10, the length of the expanded flow path 53 is inevitably determined from the length X of the narrowed flow path 51 and the length Y of the parallel flow path 52.

At the preparation step, the diffuser 40 having the length X of the narrowed flow path 51 and the length Y and the inner diameter D of the parallel flow path 52 set at the setting step is prepared. In the case of the diffuser 40 having the replaceable attachment 42 as described above, the attachment 42 having the length X of the narrowed flow path 51 and the length Y and the inner diameter D of the parallel flow path 52 set at the setting step is prepared. For example, for various maximum discharge pressures Pmax, multiple attachments 42 having different inner diameters D of the parallel flow path 52 and each having the narrowed flow paths 51 and the parallel flow paths 52 satisfying the expressions (1) and (2) are prepared. From these attachments 42, the attachment 42 suitable for the operation status or specifications of the apparatus as the steam supply destination is selected.

The method for manufacturing the ejector 10 further includes an assembly step. At the assembly step, the nozzle 20, the suction chamber 30, and the diffuser 40 are assembled together. Specifically, the nozzle 20 and the upstream portion 41 of the diffuser 40 are attached to the suction chamber 30. Then, the attachment 42 and the downstream portion 43 are attached to the upstream portion 41 with the attachment 42 being sandwiched between the upstream portion 41 and the downstream portion 43.

As described above, the ejector 10 includes the nozzle 20 configured to eject the high-pressure steam (the first fluid), the suction chamber 30 configured to house the nozzle 20 and to suck the low-pressure steam (the second fluid) by the negative pressure generated by ejection of the high-pressure steam from the nozzle 20, and the diffuser 40 having the outlet flow path 50 communicating with the suction chamber 30 and configured to mix and discharge the high-pressure steam and the low-pressure steam of the suction chamber 30. The outlet flow path 50 includes the narrowed flow path 51 having the sectional area decreasing toward the downstream side, the parallel flow path 52 connected to the downstream end of the narrowed flow path 51 and having the constant sectional area, and the expanded flow path 53 connected to the downstream end of the parallel flow path 52 and having the sectional area increasing toward the downstream side. The diffuser 40 further includes the attachment 42 (the changing unit) configured to change the dimensions of the outlet flow path 50. The attachment 42 changes the length X of the narrowed flow path 51 and the length Y and the inner diameter D of the parallel flow path 52 such that the following expressions (1) and (2) are satisfied:

$$X=A\times D \quad (1);$$

and $$Y=B\times D \quad (2),$$

where A and B are constants.

According to this configuration, the length X of the narrowed flow path 51 and the length Y and the inner diameter D of the parallel flow path 52 are changed by the attachment 42. When the inner diameter D of the parallel flow path 52 is changed, the maximum discharge pressure Pmax of the ejector 10 can be changed. In this case, the length X of the narrowed flow path 51 and the length Y and the inner diameter D of the parallel flow path 52 satisfy the expressions (1) and (2) before and after change. The performance of the ejector 10 is influenced by various dimensions of the outlet flow path 50. The length X of the narrowed flow path 51 and the length Y and the inner diameter D of the parallel flow path 52 are set such that at least the expressions (1) and (2) are satisfied, and therefore, degradation of the performance of the ejector 10 can be reduced. That is, degradation of the performance of the ejector 10 can be reduced while the maximum discharge pressure Pmax of the ejector 10 can be changed.

Specifically, part of the diffuser 40 is formed from the replaceable attachment 42. The attachment 42 includes at least the downstream end portion of the narrowed flow path 51, the parallel flow path 52, and at least the upstream end portion of the expanded flow path 53. The dimensions of the outlet flow path 50 are changed by replacement of the attachment 42 while the expressions (1) and (2) are satisfied.

That is, the diffuser 40 is configured such that the attachment 42 is replaceable. At multiple attachments 42, the narrowed flow paths 51 and the parallel flow paths 52 with different dimensions are formed. Note that the narrowed flow path 51 and the parallel flow path 52 in the case of incorporating one attachment 42 and the narrowed flow path 51 and the parallel flow path 52 in the case of incorporating another attachment 42 satisfy the expressions (1) and (2). As a result, the maximum discharge pressure Pmax of the ejector 10 can be changed by replacement of the attachment 42 without the need for replacement of the entirety of the diffuser 40, and degradation of the performance of the ejector upon such a change 10 can be reduced.

In addition, the method for manufacturing the ejector 10 includes the setting step of setting the dimensions of the outlet flow path 50, and the preparation step of preparing the diffuser 40 having the dimensions of the outlet flow path 50 set at the setting step. At the setting step, the length X of the narrowed flow path 51 and the length Y and the inner diameter D of the parallel flow path 52 are set such that the expressions (1) and (2) are satisfied.

$$X=A\times D \quad (1),$$

and $$Y=B\times D \quad (2),$$

where A and B are constants.

According to this configuration, the ejectors 10 with different maximum discharge pressures Pmax can be manufactured while degradation of the performance of the ejector 10 can be lowered.

Moreover, at the preparation step, the diffuser 40 having the length X of the narrowed flow path 51 and the length Y and the inner diameter D of the parallel flow path 52 set at the setting step is prepared by replacement of the attachment 42 of the diffuser 40 including the replaceable attachment 42.

That is, the dimensions of the narrowed flow path 51 and the parallel flow path 52 of the diffuser 40 are changed by replacement of the attachment 42. Thus, the dimensions of the narrowed flow path 51 and the parallel flow path 52 can be changed without the need for changing the entirety of the diffuser 40.

Further, the method for setting the outlet flow path of the diffuser 40 includes the step of setting the length X of the narrowed flow path 51 such that the expression (1) represented using the inner diameter D of the parallel flow path 52 and the constant A is satisfied, and the step of setting the length Y of the parallel flow path 52 such that the expression (2) represented using the inner diameter D and the constant B is satisfied.

$$X=A\times D \quad (1),$$

and $$Y=B\times D \quad (2),$$

where A and B are constants.

Other Embodiments

As described above, the embodiment has been described as an example of the technique disclosed in the present application. However, the technique of the present disclosure is not limited to above, and is also applicable to embodiments to which changes, replacements, additions, omissions, etc. are made as necessary. Moreover, each component described above in the embodiment may be combined to form a new embodiment. Further, the components described in the detailed description with reference to the attached drawings may include not only components essential for solving the problems, but also components not essential for solving the problems and provided for illustrating the above-described technique by an example. Thus, description of the non-essential components in the detailed description with reference to the attached drawings should not be directly recognized as these non-essential components being essential.

The above-described embodiment may have the following configurations.

The diffuser 40 has the structure divided into three portions, but may have a structure divided into two portions or four or more portions.

Moreover, the method for fixing the attachment 42 is not limited to sandwiching between the upstream portion 41 and the attachment 42. As long as the attachment 42 can be fixed, an optional fixing method can be employed.

Further, the configuration for changing the dimensions of the outlet flow path 50 is not limited to the configuration by the attachment 42. For example, the diffuser may include a deformable mechanism capable of changing the inner diameter. The deformable mechanism may have a tubular wall portion configured to form the outlet flow path 50 and exhibiting flexibility, and multiple pressing members (e.g., bolts) arranged at the outer periphery of the wall portion in a circumferential direction and configured to press the wall portion inward in a radial direction. The wall portion is deformed in such a manner that the wall portion is pressed inward in the radial direction by the pressing member. Accordingly, the inner diameter of the wall portion is decreased. Thus, the inner diameter D, i.e., the sectional area, of the parallel flow path 52 can be changed. Further, multiple sets of the pressing members are provided at different positions of the wall portion in an axial direction thereof, multiple pressing members arranged in the circumferential direction of the wall portion being taken as a single set. That is, depending on at which positions in the axial direction the pressing members are pressed, the length Y and the axial position of the parallel flow path 52 can be changed. A change in the axial position of the parallel flow path 52 leads to a change in the length X of the narrowed flow path 51. That is, the length X of the narrowed flow path 51 and the length Y of the parallel flow path 52 can be also changed. In other configurations than above, an optional configuration capable of changing the dimensions of the outlet flow path 50 can be employed.

Further, the diffuser 40 has the divided structure including the attachment 42, but is not limited to above. For example, the diffuser 40 may have an integrated structure. In this case, multiple diffusers 40 each have the outlet flow paths 50 with different dimensions, and the narrowed flow path 51 and the parallel flow path 52 of each outlet flow path 50 satisfy the expressions (1) and (2). Among these diffusers 40, the suitable diffuser 40 is selected, and is incorporated into the ejector 10. That is, at the preparation step in the method for manufacturing the ejector 10, the diffuser 40 having the length X of the narrowed flow path 51 and the length Y and the inner diameter D of the parallel flow path 52 set at the setting step is selected from multiple diffusers 40, or is newly produced.

The technique disclosed herein is useful for the ejector, the method for manufacturing the ejector, and the method for setting the outlet flow path of the diffuser used for the ejector.

What is claimed:

1. An ejector system comprising:

a nozzle configured to eject first fluid;

a suction chamber configured to house the nozzle and to suck second fluid by negative pressure generated by ejection of the first fluid from the nozzle;

a diffuser including an outlet flow path and configured to mix and discharge the first fluid and the second fluid of the suction chamber; and a plurality of replaceable attachments configured to be used in the diffuser, wherein the outlet flow path includes a narrowed flow path having a sectional area narrowed toward downstream, a parallel flow path connected to a downstream end of the narrowed flow path and having a constant sectional area, and an expanded flow path connected to a downstream end of the parallel flow path and having a sectional area expanded toward downstream, each replaceable attachment is configured to change a dimension of the outlet flow path and includes at least part of the narrowed flow path, the parallel flow path, and at least part of the expanded flow path, replacement of one of the replaceable attachments changes a dimension of the outlet flow path, one attachment is selected from the plurality of replaceable attachments for use in the diffuser, the plurality of replaceable attachments including at least a first attachment and a second attachment, the first attachment has an inner diameter d1 and a length y1 of the parallel flow path, the narrowed flow path of the diffuser to which the first attachment is attached has a length x1, the second attachment has an inner diameter d2 and a length y2 of the parallel flow path, the narrowed flow path of the diffuser to which the second attachment is attached has a length x2, x1/d1 is substantially equal to x2/d2, and y1/d1 is substantially equal to y2/d2, where x1 is different from x2, y1 is different from y2, and d1 is different from d2.

2. A method for manufacturing an ejector including a nozzle configured to eject first fluid, a suction chamber configured to house the nozzle and to suck second fluid by negative pressure generated by ejection of the first fluid from the nozzle, a diffuser including an outlet flow path having a narrowed flow path having a sectional area narrowed toward downstream, and a plurality of replaceable attachments configured to be used in the diffuser, a parallel flow path connected to a downstream end of the narrowed flow path and having a constant sectional area, and an expanded flow path connected to a downstream end of the parallel flow path and having a sectional area expanded toward downstream and configured to mix and discharge the first fluid and the second fluid of the suction chamber, comprising:

a setting step of setting a dimension of the outlet flow path; and a preparation step of preparing the diffuser having the dimension of the outlet flow path set at the setting step by replacement of one of the plurality of replaceable attachments, wherein at the preparation step, the one replaceable attachment is selected from the plurality of replaceable attachments, the plurality of replaceable attachments including at least a first attachment and a second attachment according to the dimension of the outlet flow path set at the setting step, each replaceable attachment includes at least part of the narrowed flow path, the parallel flow path, and at least part of the expanded flow path, the first attachment has an inner diameter d1 and a length y1 of the parallel flow path, the narrowed flow path of the diffuser to which the first attachment is attached has a length x1, the second attachment has an inner diameter d2 and a length y2 of the parallel flow path, the narrowed flow path of the diffuser to which the second attachment is attached has a length x2, x1/d1 is substantially equal to x2/d2, and y1/d1 is substantially equal to y2/d2, where x1 is different from x2, y1 is different from y2, and d1 is different from d2.

* * * * *